US007217167B2

(12) United States Patent
Mizuguchi et al.

(10) Patent No.: US 7,217,167 B2
(45) Date of Patent: May 15, 2007

(54) OUTBOARD MOTOR SHIFT DEVICE

(75) Inventors: Hiroshi Mizuguchi, Wako (JP); Hideaki Takada, Wako (JP)

(73) Assignee: Honda Motor Co., Ltd, Tokyo (JP)

( * ) Notice: Subject to any disclaimer, the term of this patent is extended or adjusted under 35 U.S.C. 154(b) by 0 days.

(21) Appl. No.: 11/302,040

(22) Filed: Dec. 13, 2005

(65) Prior Publication Data

US 2006/0128236 A1 Jun. 15, 2006

(30) Foreign Application Priority Data

Dec. 14, 2004 (JP) ..... 2004-361633

(51) Int. Cl.
*B63H 21/21* (2006.01)

(52) U.S. Cl. ..... 440/86; 74/473.12

(58) Field of Classification Search ..... 440/75, 440/86; 192/21, 35, 44, 45, 51; 74/473.12
See application file for complete search history.

(56) References Cited

U.S. PATENT DOCUMENTS 5,910,191 A * 6/1999 Okamoto ..... 440/86
6,238,255 B1 * 5/2001 Takase ..... 440/86
6,692,320 B1 * 2/2004 Sawyer ..... 440/86
6,905,382 B2 * 6/2005 Ochiai et al. ..... 440/86

FOREIGN PATENT DOCUMENTS

JP 2004-245350 9/2004

* cited by examiner

*Primary Examiner*—Lars A. Olson
(74) *Attorney, Agent, or Firm*—Carrier, Blackman & Associates, P.C.; Joseph P. Carrier; William D. Blackman

(57) ABSTRACT

In an outboard motor shift device having a clutch being engageable with a forward gear or a reverse gear, a shift rod being rotatable to slide the clutch to engage with the gear, an electric motor connected to rotate the shift rod, a speed reduction gear mechanism transmitting an output of the motor to the shift rod at a reduced speed, a manual operation mechanism is provided to be manually operable by an operator and breaking output transmission train of the speed reduction gear mechanism such that the shift rod can be manually rotated by the operator, thereby enhancing reliability by enabling shifting both by actuator and manually and minimizing operation load during manual shifting.

6 Claims, 9 Drawing Sheets

OUTBOARD MOTOR SHIFT DEVICE

BACKGROUND OF THE INVENTION

1. Field of the Invention

This invention relates to an outboard motor shift device.

2. Description of the Related Art

Japanese Laid-Open Patent Application No. 2004-245350 (particularly paragraphs 0048 to 0050 and FIGS. 10 and 11), for example, teaches a shift device that changes the gear position of an outboard motor by using an actuator to drive a shift rod that operates a clutch.

In the technique taught by this reference, the reduction gear mechanism for transmitting the output of the actuator to the shift rod is equipped with a manually operable emergency gear to be used in case of failure of the actuator or its control system. The reliability of the system is therefore enhanced because even if driving of the shift rod by the actuator should become impossible, the operator can still shift the outboard motor by manually rotating the emergency gear which in turn rotates the shift rod through the reduction gear mechanism.

When the operator's rotation of the emergency gear is transmitted to the shift rod, it is also simultaneously transmitted to the actuator. In the prior art, therefore, the operation load experienced by the operator when turning the emergency gear, i.e., when manually operating the shift rod, is large.

SUMMARY OF THE INVENTION

An object of this invention is therefore to overcome this drawback and to provide an outboard motor shift device that enhances reliability by enabling shifting both by the actuator and manually which minimizes operation load during manual shifting.

In order to achieve the object, this invention provides a device for shifting a gear of an outboard motor adapted to be mounted on a stern of a boat among a forward position, a reverse position and a neutral position such that the boat may be propelled in a direction determined by the gear position, comprising: a clutch being engageable with a forward gear or a reverse gear; a shift rod rotatable to slide the clutch to engage with the gears; an actuator connected to rotate the shift rod; a speed reduction gear mechanism transmitting an output of the actuator to the shift rod at a reduced speed; and a manual operation mechanism manually operable by an operator to break an output transmission train of the speed reduction gear mechanism such that the shift rod can be manually rotated by the operator.

BRIEF DESCRIPTION OF THE DRAWINGS

The above and other objects and advantages of the invention will be more apparent from the following description and drawings in which.

DETAILED DESCRIPTION OF THE PREFERRED EMBODIMENT

An embodiment of an outboard motor shift device according to the present invention will now be explained with reference to the attached drawings.

Figure 1:
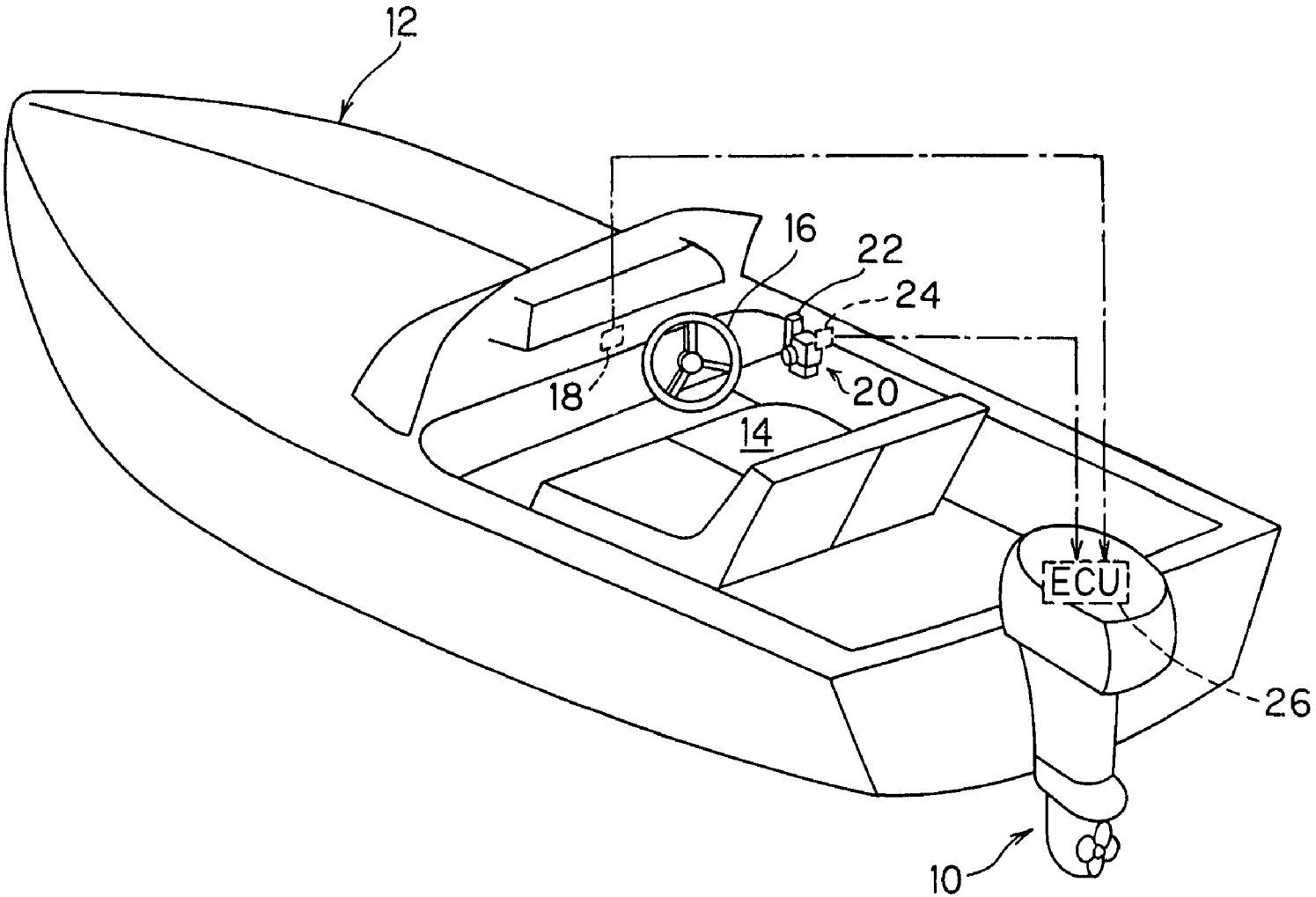
FIG. 1 is an overall schematic view of an outboard motor shift device, as mounted on a boat (hull), according to an embodiment of the invention.
Figure 2:
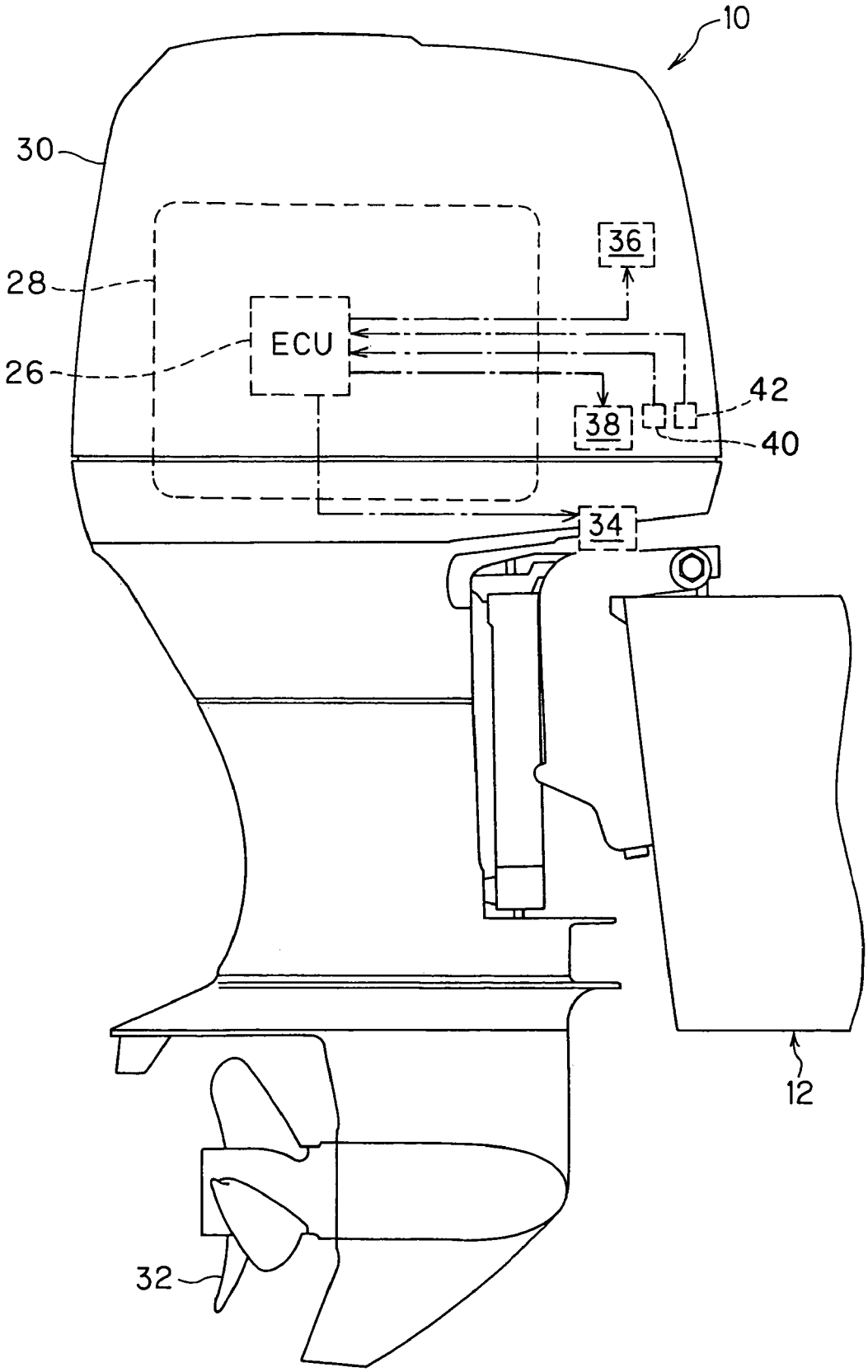
FIG. 2 is a side view of the outboard motor shown in FIG. 1.

FIG. 1 is an overall schematic view of an outboard motor shift device as mounted on a boat (hull), according to an embodiment of the invention and FIG. 2 is a side view of the outboard motor shown in FIG. 1.

In FIGS. 1 and 2, the symbol 10 indicates an outboard motor. The outboard motor 10 is mounted on the stern (transom) of a boat (hull) 12. As shown in FIG. 1, a steering wheel 16 is installed near a cockpit (the operator's seat) 14 of the boat 12. A steering angle sensor 18 is installed near a rotary shaft (not shown) of the steering wheel 16 and produces an output or a signal indicative of the steering angle (manipulated variable) of the steering wheel 16 manipulated by the operator.

A remote control box 20 is installed near the cockpit 14. The remote control box 20 is installed or provided with a lever 22 that is to be manipulated by the operator. The lever 22 is free to be rotated fore and aft (toward and away from the operator) from the initial position, and is positioned to be manipulated by the operator to input an instruction to shift or to regulate a speed of an internal combustion engine.

The remote control box 20 is equipped with a lever position sensor 24 that produces an output or a signal corresponding to a position to which the lever 22 is manipulated by the operator. The outputs from the steering angle sensor 18 and lever position sensor 24 are sent to an electronic control unit (hereinafter referred to as "ECU") 26 mounted on the outboard motor 10. The ECU 26 comprises a microcomputer.

As shown in FIG. 2, the outboard motor 10 is equipped with the internal combustion engine (now assigned with symbol 28; hereinafter referred to as "engine") at its upper portion. The engine 28 comprises a spark-ignition gasoline engine. The engine 28 is located above the water surface and covered by an engine cover 30. The ECU 26 is installed in the engine cover 30 at a location near the engine 28.

The outboard motor 10 is equipped at its lower portion with a propeller 32. The output of the engine 28 is transmitted to the propeller 32 through a shift mechanism (described below) and the like, such that the propeller 32 is rotated to generate thrust that propels the boat 12 in the forward and reverse directions.

The outboard motor 10 is further equipped with an electric steering motor (steering actuator) 34 that steers the outboard motor 10 to the right and left directions, an electric throttle motor (throttle actuator) 36 that opens and closes a throttle valve (not shown in FIG. 2) of the engine 28 and an electric shift motor (shift actuator) 38 that operates the shift mechanism (described below) by rotating a shift rod (not shown in FIG. 2) to change a gear position.

A gear position sensor 40 and neutral switch 42 are installed near the shift motor 38. The gear position sensor 40 produces an output or a signal in response to a gear position. The neutral switch 42 produces an ON signal when the neutral (gear) position is established and an OFF signal when the forward or reverse gear position is established. The outputs from the gear position sensor 40 and neutral switch 42 are sent to the ECU 26.

The ECU 26 generates an output indicative of a permission to start the operation of the engine 28 only when the neutral switch 42 outputs the ON signal, i.e., when it is detected that the gear is at the neutral position, so as to prevent the boat 12 from moving at the engine start.

The ECU 26 controls the operation of the steering motor 34 based on the output of the steering angle sensor 18 to steer the outboard motor 10 left and right. The ECU 26 also changes or shifts the gear position, i.e., conducts the gear change by controlling the operation of the shift motor 38 based on the manipulated angle of the lever 22 (more exactly, the manipulated direction of the lever 22) detected by the lever position sensor 24. When the establishment of either the forward or reverse gear position is detected from the output of the gear position sensor 40, the ECU 26 controls the operation of the throttle motor 36 based on the manipulated angle (more exactly, the magnitude of the manipulated variable) of the lever 22 to regulate the engine speed.

Figure 3:
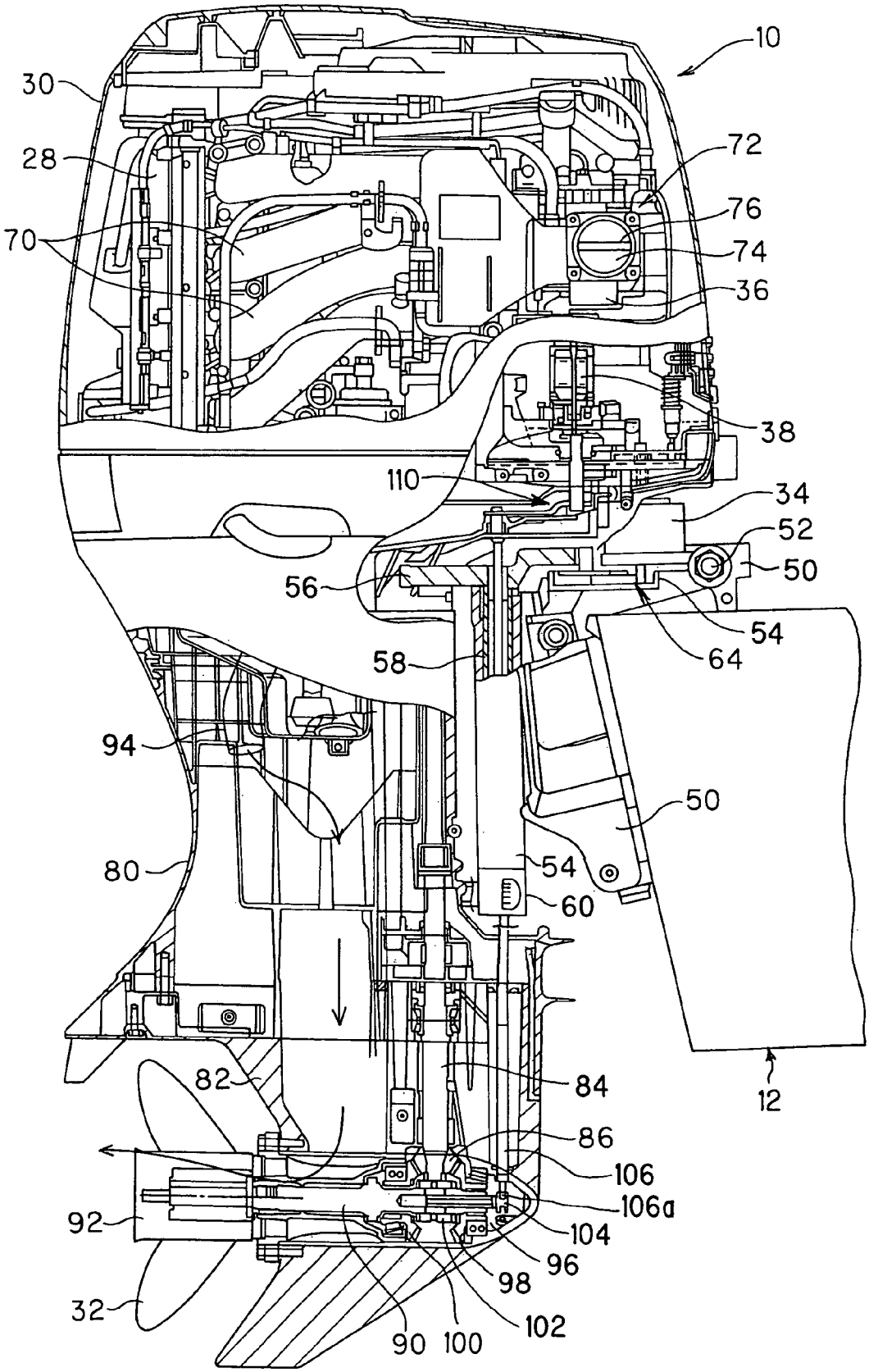
FIG. 3 is a partial sectional side view of the outboard motor shown in FIG. 1.

The structure of the outboard motor 10 will then be described in detail with reference to FIG. 3. FIG. 3 is a partial sectional view of the outboard motor 10.

As shown in FIG. 3, the outboard motor 10 is equipped with stern brackets 50 fastened to the stern of the boat 12, such that the outboard motor 10 is mounted on the stern of the boat 12 through the stern brackets 50. A swivel case 54 is attached to the stern brackets 50 through a tilting shaft 52.

The outboard motor 10 is also equipped with a mount frame 56 having a shaft 58. The shaft 58 is housed in the swivel case 54 to be freely rotated about a vertical axis. The upper end of the mount frame 56 is fastened to a frame of the outboard motor 10 and the lower end thereof is fastened to the frame through a lower mount center housing 60.

The upper portion of the swivel case 54 is installed with the steering motor 34. The output shaft of the steering motor 34 is connected to the mount frame 56 via a speed reduction gear mechanism 64. Specifically, a rotational output generated by driving the steering motor 34 is transmitted via the speed reduction gear mechanism 64 to the mount frame 56 such that the outboard motor 10 is steered about the shaft 58 as a rotational axis to the right and left directions (i.e., steered about the vertical axis).

The engine 28 has an intake pipe 70 that is connected to a throttle body 72. The throttle body 72 has a throttle valve 74 installed therein and the throttle motor 36 is integrally disposed thereto. The output shaft of the throttle motor 36 is connected via a speed reduction gear mechanism (not shown) installed near the throttle body 72 with a throttle shaft 76 that supports the throttle valve 74. Specifically, a rotational output generated by driving the throttle motor 36 is transmitted to the throttle shaft 76 to open and close the throttle valve 74, thereby regulating air sucked in the engine 28 to change the engine speed.

An extension case 80 is installed at the lower portion of the engine cover 30 that covers the engine 28 and a gear case 82 is installed at the lower portion of the extension case 80. A drive shaft (vertical shaft) 84 is supported in the extension case 80 and gear case 82 to be freely rotated about the vertical axis. One end, i.e., the upper end of the drive shaft 84 is connected to a crankshaft (not shown) of the engine 28 and the other end, i.e., the lower end thereof is equipped with a pinion gear 86.

A propeller shaft 90 is supported in the gear case 82 to be freely rotated about the horizontal axis. One end of the propeller shaft 90 extends from the gear case 82 toward the rear of the outboard motor 10 and the propeller 32 is attached thereto, i.e., the one end of the propeller shaft 90, via a boss portion 92.

As indicated by the arrows in FIG. 3, the exhaust gas (combusted gas) emitted from the engine 28 is discharged from an exhaust pipe 94 into the extension case 80. The exhaust gas discharged into the extension case 80 further passes through the interior of the gear case 82 and the interior of the propeller boss portion 92 to be discharged into the water to the rear of the propeller 32.

The shift mechanism (now assigned with symbol 96) is also housed in the gear case 82. The shift mechanism 96 comprises a forward bevel gear 98, reverse bevel gear 100, clutch 102 and shift slider 104.

The forward bevel gear 98 and reverse bevel gear 100 are disposed onto the outer periphery of the propeller shaft 90 to be rotatable in opposite directions by engagement with the pinion gear 86. The clutch 102 is installed between the forward bevel gear 98 and reverse bevel gear 100 and rotates integrally with the propeller shaft 90.

A shift rod 106 penetrates from the upper portion to the lower portion of the interior of the outboard motor 10. Specifically, the shift rod 106 is supported to be freely rotated about the vertical axis in a space from the engine cover 30, passing through the swivel case 54 (more specifically the interior of the shaft 58 accommodated therein), to the gear case 82. The clutch 102 is connected via the shift slider 104 to a rod pin **106*a* disposed on the bottom of the shift rod 106**.

The rod pin **106*a* is formed at a location offset from the center of the bottom of the shift rod 106 by a predetermined distance. As a result, rotation of the shift rod 106 causes the rod pin 106*a*** to move while describing an arcuate locus whose radius is the predetermined distance (offset amount).

The movement of the rod pin **106*a* is transferred through the shift slider 104 to the clutch 102 as displacement parallel to the axial direction of the propeller shaft 90. As a result, the clutch 102 is slid to a position where it engages one or the other of the forward bevel gear 98 and reverse bevel gear 100** or to a position where it engages neither of them.

When the clutch 102 is engaged with the forward bevel gear 98, the rotation of the drive shaft 84 is transmitted through the pinion gear 86 and forward bevel gear 98 to the propeller shaft 90, thereby rotating the propeller 32 to produce thrust in the direction of propelling the boat 12 forward. Thus the forward gear position is established.

When the clutch 102 is engaged with the reverse bevel gear 100, the rotation of the drive shaft 84 is transmitted through the pinion gear 86 and reverse bevel gear 100 to the propeller shaft 90, thereby rotating the propeller 32 in the direction opposite from that during forward travel to produce thrust in the direction of propelling the boat 12 rearward. Thus the reverse gear position is established.

When the clutch 102 is not engaged with either the forward bevel gear 98 or the reverse bevel gear 100, the rotation of the drive shaft 84 is not transmitted to the propeller shaft 90. Thus the neutral position is established.

The explanation of FIG. 3 will be resumed. The shift motor 38 is installed inside the engine cover 30 and its output shaft is connected to the upper end of the shift rod 106 through a speed reduction gear mechanism 110. Therefore, when the shift motor 38 is driven, its rotational output is transmitted to the shift rod 106 through the speed reduction gear mechanism 110, thereby rotating the shift rod 106. The shift mechanism 96 is operated (specifically, the clutch 102 is slid) in response to the rotation of the shift rod 106 so as to select a gear position from among the foregoing forward, neutral and reverse positions.

Figure 4:
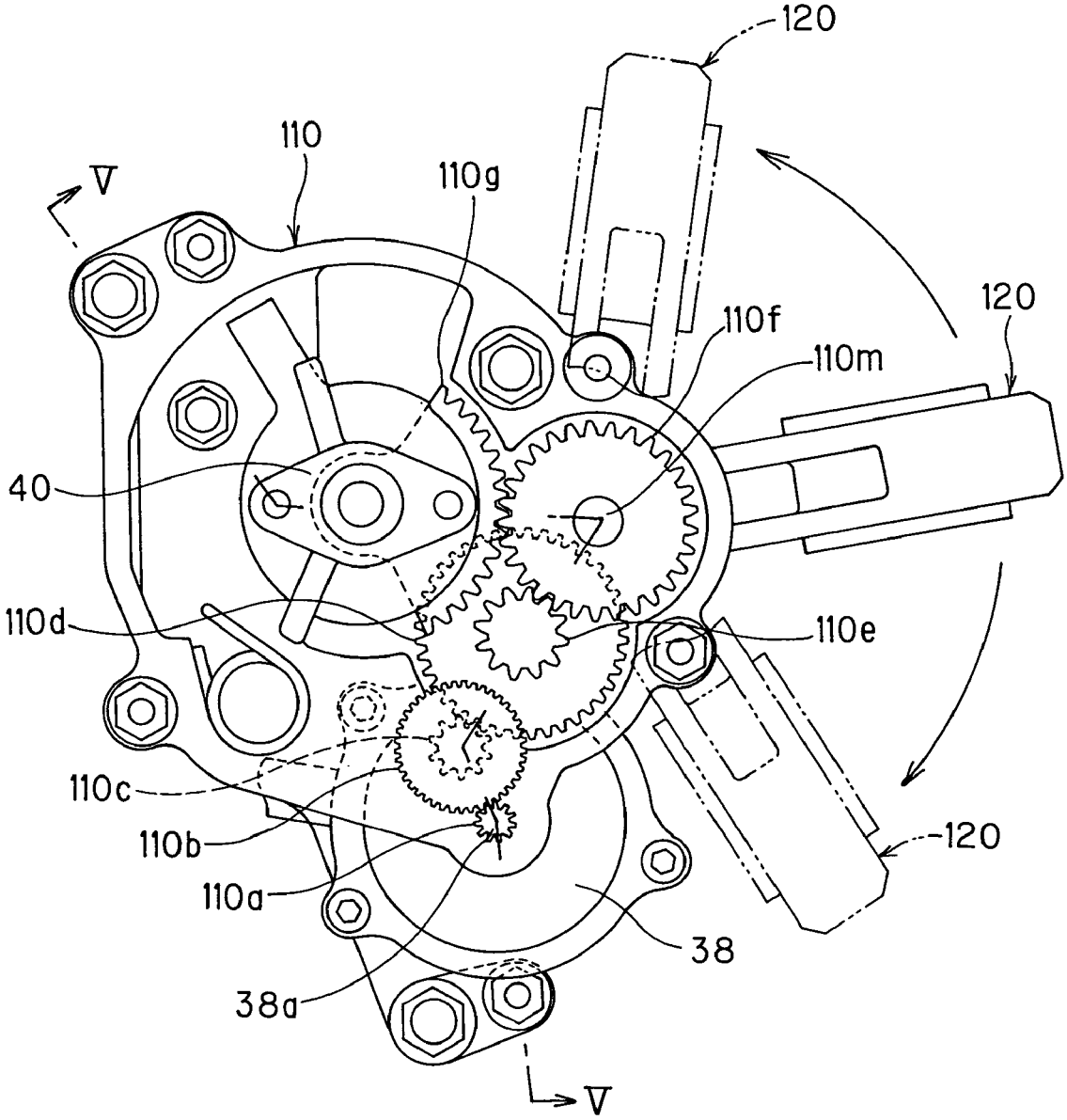
FIG. 4 is an enlarged, partially see-through, plan view showing the region of an electric shift motor shown in FIG. 3.
Figure 5:
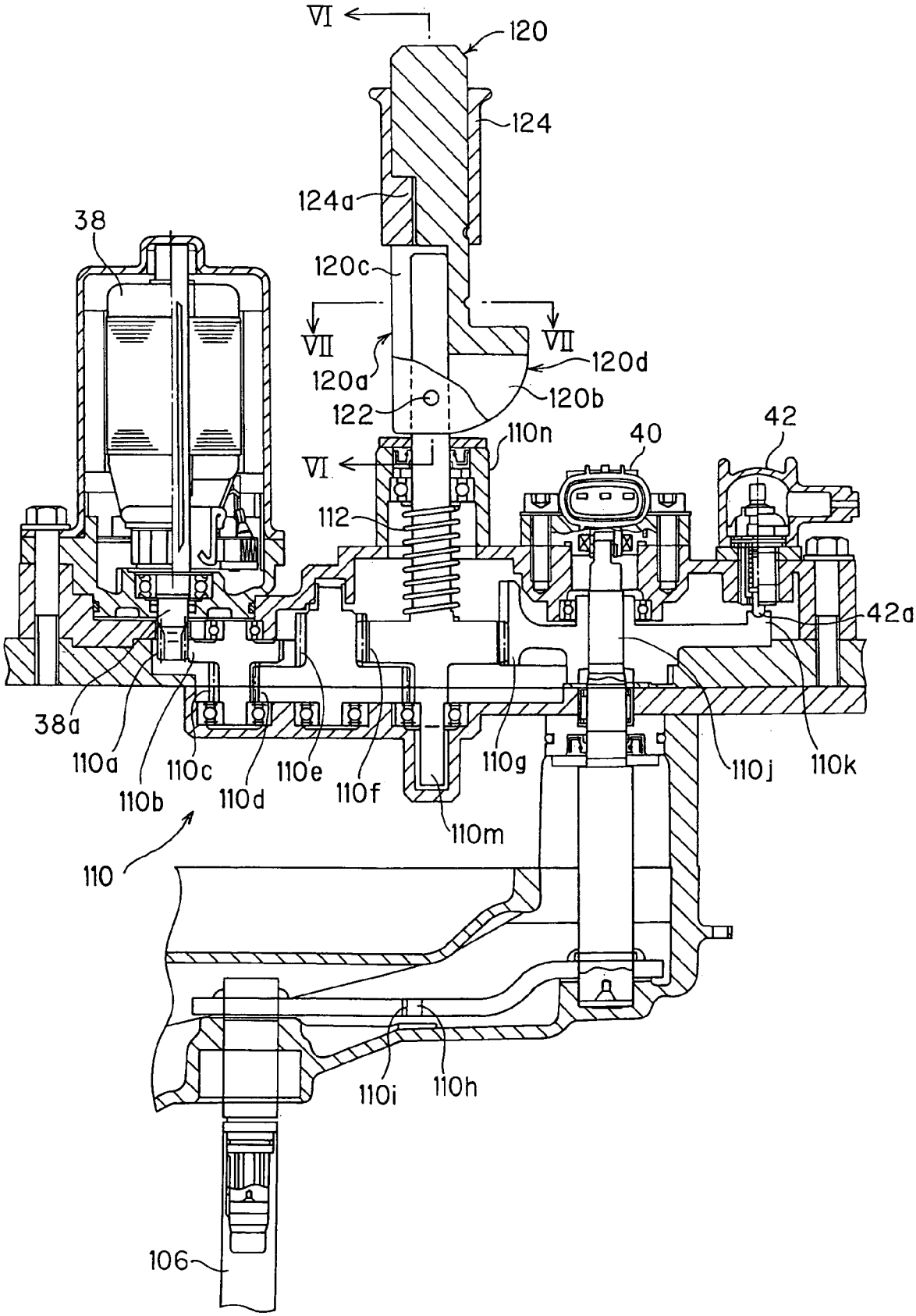
FIG. 5 is a sectional view taken along line V—V in FIG. 4.

FIG. 4 is an enlarged, partially see-through, plan view showing the region of the shift motor 38. FIG. 5 is a sectional view taken along line V–V in FIG. 4.

As shown in FIGS. 4 and 5, the output shaft 38*a* of the shift motor 38 is connected to the upper end of the shift rod 106 through the reduction gear mechanism 110. The reduction gear mechanism 110 is a multi-gear mechanism comprising first to ninth gears 110*a* to 110*i*.

The first gear 110*a* is provided on the shift motor output shaft 38*a* and meshes with the second gear 110*b* of larger diameter. The third gear 110*c*, which is smaller in diameter than the second gear 110*b*, is provided on the same shaft as the second gear 110*b* and meshes with the fourth gear 110*d* of larger diameter. The fifth gear 110*e*, which is smaller in diameter than the fourth gear 110*d*, is provided on the same shaft as the fourth gear 110*d* and meshes with the sixth gear 110*f* of larger diameter. The sixth gear 110*f* meshes with the seventh gear 110*g* of larger diameter.

As shown in FIG. 5, the eighth gear 110*h* is provided on the same shaft as the seventh gear 110*g*. The eighth gear 110*h* meshes with the ninth gear 110*i*, which is provided on the upper end of the shift rod 106. The output of the shift motor 38 is therefore transmitted to the shift rod 106 by the reduction gear mechanism 110 at reduced speed and increased torque. The aforesaid gear position sensor 40 is attached to the rotary shaft 110*j* of the seventh gear 110*g*. The gear position sensor 40 outputs the rotation angle of the rotary shaft 110*j* as a signal indicating the gear position.

The neutral switch 42 is located above the seventh gear 110*g*. As shown in FIG. 5, the neutral switch 42 is equipped with a detection member 42*a*. A protrusion 110*k* rising from the upper surface of the seventh gear 110*g* makes contact with the detection member 42*a* of the neutral switch 42 when the gear position is neutral. When the protrusion 110*k* makes contact with the detection member 42*a*, the neutral switch 42 outputs an ON signal as a signal indicating that the gear position is neutral. The outputs of the gear position sensor 40 and neutral switch 42 are sent to the ECU 26 via signal lines not shown in the drawings.

The sixth gear 110*f* is slidable in the tooth facewidth direction together with its rotary shaft 110*m*. The sixth gear 110*f* is hereinafter referred to as a "sliding gear." As shown in FIG. 5, the gears on the upstream and downstream sides of the sliding gear 110*f* in the output transmission train of the reduction gear mechanism 110 (the train from the first gear 110*a* to ninth gear 110*i*), i.e., the fifth gear 110*e* and seventh gear 110*g*, are different in facewidth. Namely, the facewidth of the seventh gear 110*g* is larger than that of the fifth gear 110*e* and the difference (extra facewidth) extends upward from the level of the top surface of the fifth gear 110*e*. The sliding gear 110*f* is urged downward by a spring 112. That is, it is biased in the direction of meshing with both the fifth gear 110*e* and the seventh gear 110*g*.

The upper segment of the rotary shaft 110*m* of the sliding gear 110*f* projects upward beyond the casing 110*n* of the reduction gear mechanism 110, and a manual lever 120 is attached to the portion rising above the casing 110*n*. The manual lever 120 is positioned so that it can be readily manipulated by the boat operator.

The sliding gear 110*f* and manual lever 120 constitute a manual operation mechanism for manually rotating the shift rod 106. Here follows an explanation of the structure of the manual lever 120 and the operation of the manual operation mechanism.

Figure 6:
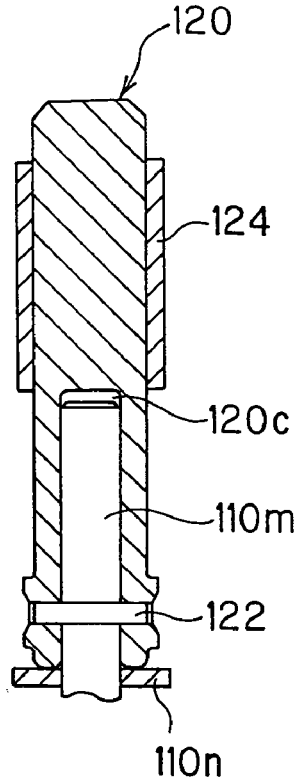
FIG. 6 is a sectional view taken along line VI—VI in FIG. 5.
Figure 7:
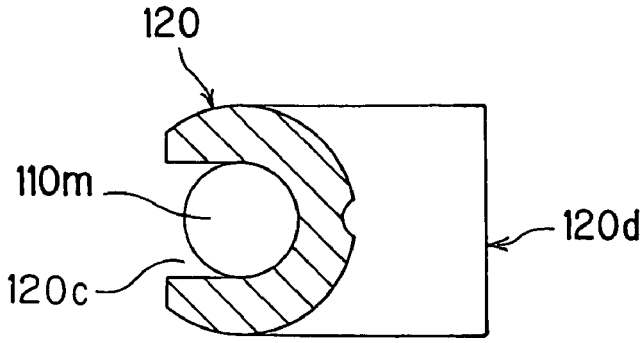
FIG. 7 is an enlarged sectional view taken along line VII—VII in FIG. 5.

FIG. 6 is a sectional view taken along line VI—VI in FIG. 5. FIG. 7 is an enlarged sectional view taken along line VII—VII in FIG. 5.

As shown in FIGS. 5 to 7, the manual lever 120 is shaped substantially like a cylinder or rod. The manual lever 120 is provided with an L-shaped grooved section 120*a* formed as an indentation continuing across its bottom and side faces. More exactly, the grooved section 120*a* is composed of a groove 120*b* formed in the bottom face of the manual lever 120 and a groove 120*c* formed in the side face of the manual lever 120 to run parallel to the longitudinal direction (generating line direction) of the manual lever 120. The rotary shaft 110*m* is inserted into the grooved section 120*a* and is connected to the manual lever 120 at its corner region (where the groove 120*b* and groove 120*c* meet at right angles) by a pin 122.

This structure enables the manual lever 120 to rotate around the pin 122 by 90 degrees relative to the rotary shaft 110*m*. More specifically, the manual lever 120 can be manipulated so that its longitudinal axis rotates between an upright orientation parallel to the axial direction of the rotary shaft 110*m* and a horizontal orientation perpendicular to the axial direction of rotary shaft 110*m*. The manual lever 120 is shown in its horizontal orientation in FIG. 4 discussed above.

The lower end of the manual lever 120 is formed with a cam member 120*d* riding on the casing 110*n* of the reduction gear mechanism 110. The cam member 120*d* is elongated in the direction perpendicular to the longitudinal direction of the manual lever 120, specifically in the direction away from the opening direction of the groove 120*c* (to the right in FIG. 5).

Figure 8:
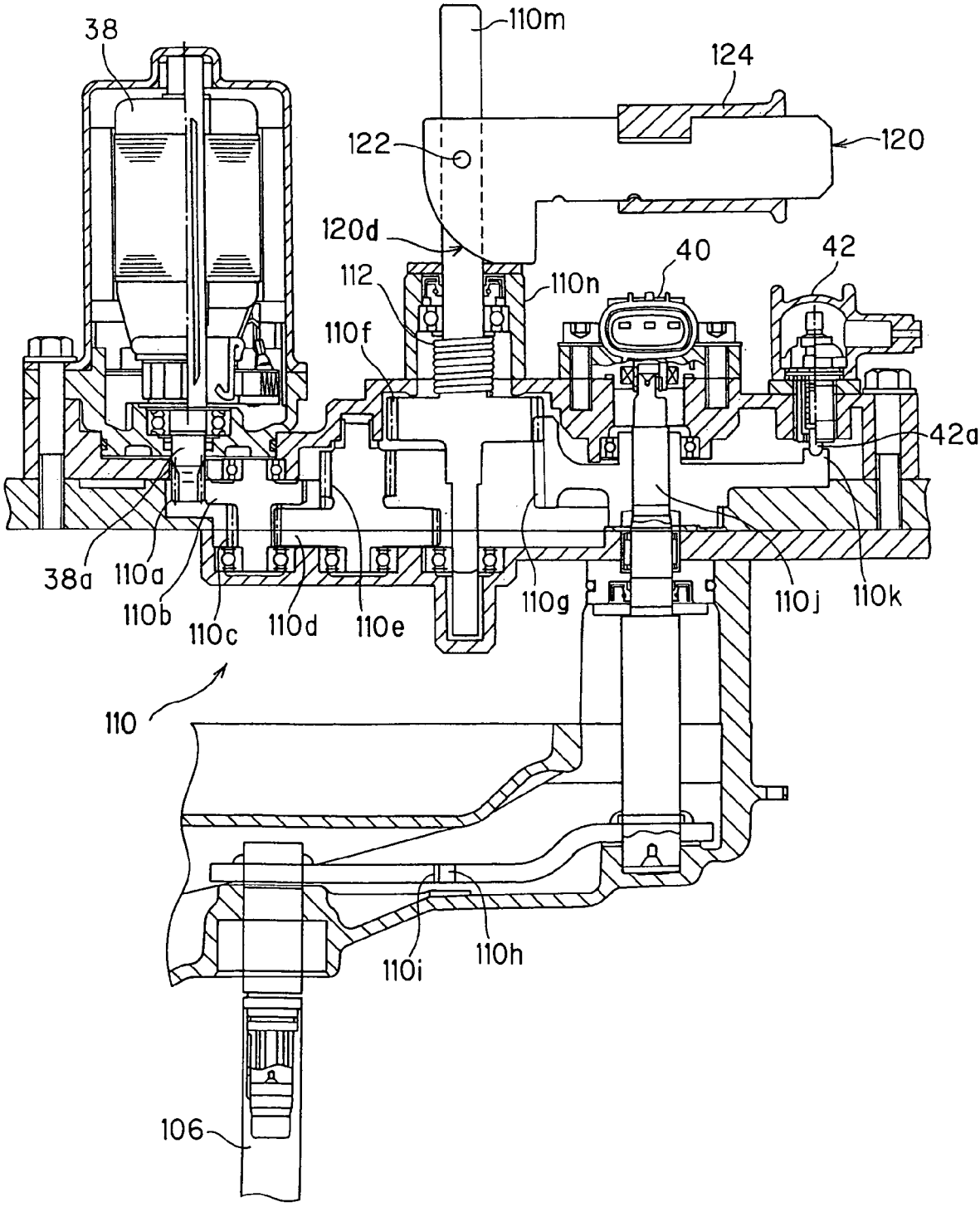
FIG. 8 is a sectional view similar to FIG. 5.

Therefore, as shown in FIG. 8, when the manual lever 120 is tipped toward the elongated direction of the cam member 120*d* (to the right in FIG. 5), the distance from the surface of contact between the cam member 120*d* and casing 110*n* and the pin 122 is increased. As a result, the rotary shaft 110*m* is slid upward, thereby also sliding the sliding gear 110*f* upward to disengage it from the fifth gear 110*e*. This means that the output transmission train of the reduction gear mechanism 110 is broken between the sliding gear 110*f* and the fifth gear 110*e* upstream thereof, thus breaking the mechanical connection between the shift motor 38 and shift rod 106.

On the other hand, the seventh gear 110*g* located downstream of the sliding gear 110*f* is given a larger facewidth than that of the fifth gear 110*e* and the difference (extra facewidth) extends upward from the level of the top surface of the fifth gear 110*e*. The sliding gear 110*f* and seventh gear 110*g* therefore stay meshed after the sliding gear 110*f* is slid upward. So when the boat operator swings the manual lever 120 to the right or left as shown in FIG. 4, the rotation is transmitted to the shift rod 106 via the seventh gear 110*g* to the ninth gear 110*i*. That is to say, the gear position can be changed by manipulating the manual lever 120 so as to rotate the shift rod 106 manually.

The explanation of FIGS. 5 to 7 will be resumed. The manual lever 120 is provided with a sliding member 124. The sliding member 124 is given a cylindrical shape and is installed to cover the outer face of the manual lever 120 and be manually slidable in the longitudinal direction by the boat operator. The sliding member 124 is provided with a blocking section 124*a*.

Figure 9:
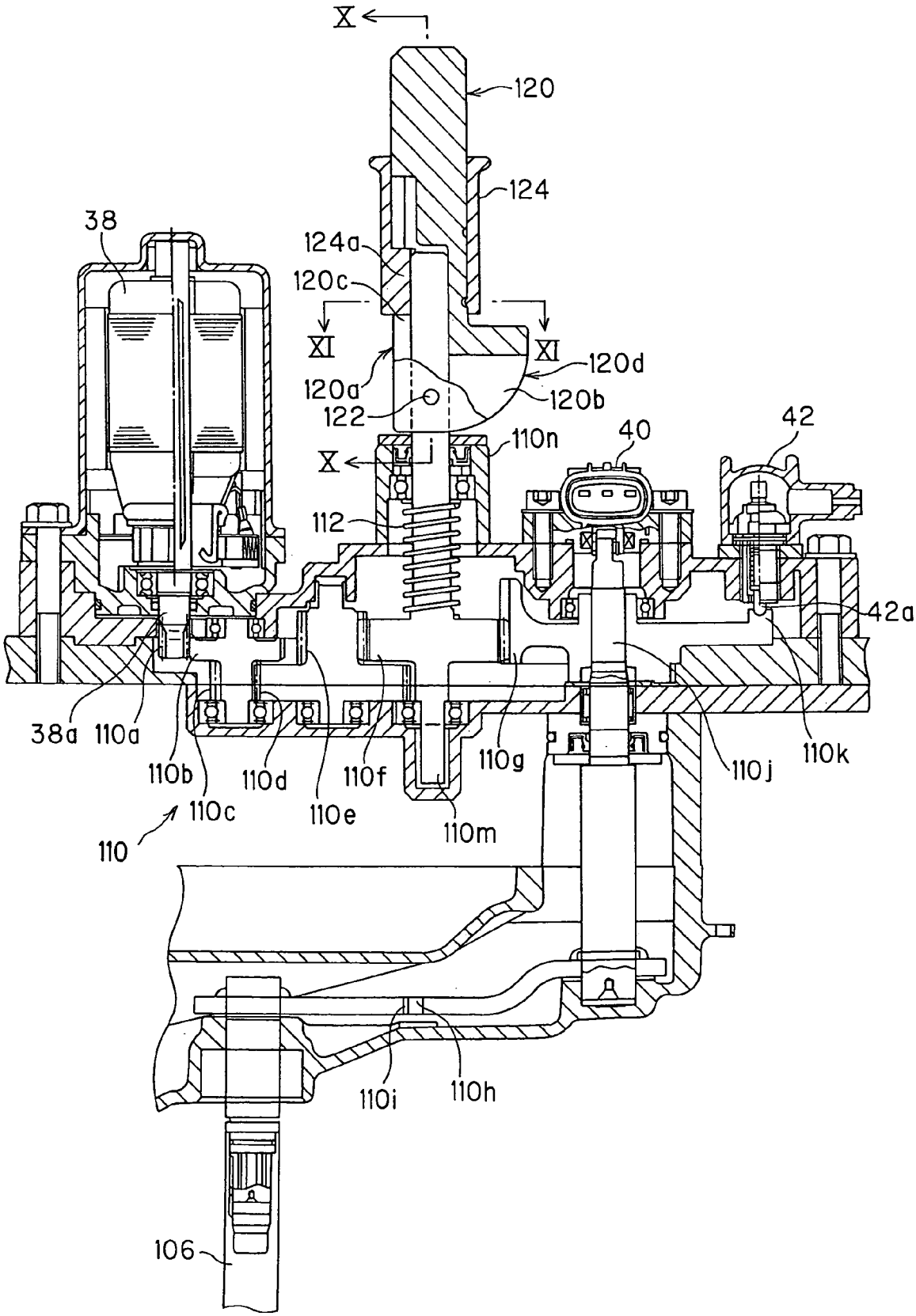
FIG. 9 is a sectional view similar to FIG. 5.
Figure 10:
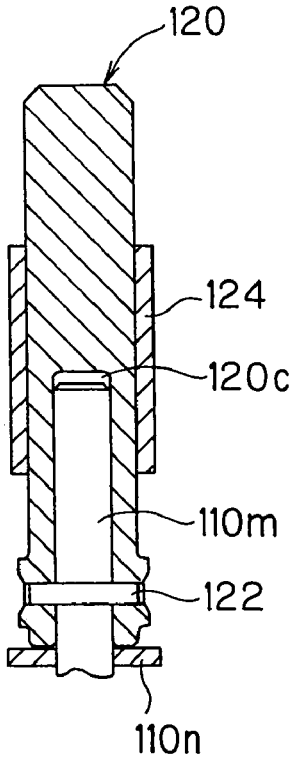
FIG. 10 is a sectional view taken along line X—X in FIG. 9.

FIG. 9 is a sectional view similar to FIG. 5 showing the sliding member 124 after being slid from the location shown in FIG. 5. FIG. 10 is a sectional view taken along line X—X in FIG. 9 and FIG. 11 is an enlarged sectional view taken along line XI—XI in FIG. 9.

Figure 11:
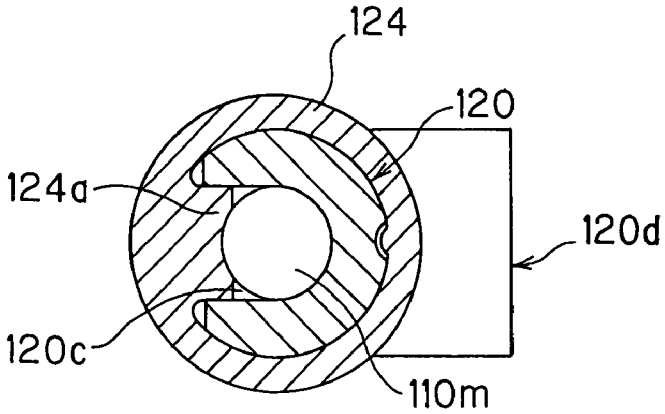
FIG. 11 is an enlarged sectional view taken along line XI—XI in FIG. 9.

As shown in FIGS. 9 to 11, when the sliding member 124 is slid downward along the manual lever 120, the groove 120*c* is blocked by the blocking section 124*a*. As a result, the rotary shaft 110*m* is constrained within the groove 120*c*, thereby preventing tipping of the manual lever 120 from the upright orientation.

When the gear position can be changed normally by the shift motor 38, the shift rod 106 is protected against manual misoperation by sliding the sliding member 124 downward along the upright manual lever 120 to lock the manual lever 120 in the upright orientation. When the gear position cannot be changed normally by the shift motor 38, the boat operator unlocks the manual lever 120 by sliding the sliding member 124 upward, swings the manual lever 120 downward by 90 degrees to put it in the horizontal orientation, and then rotates manual lever 120 to the right or left to change the gear position manually.

Thus the outboard motor shift device according to this embodiment of the invention is provided in the reduction gear mechanism 110 for transmitting the output of the shift motor 38 to the shift rod 106 at reduced speed and increased torque with a manual operation mechanism that is manually operable for breaking the output transmission train of the reduction gear mechanism 110 and enabling manual rotation of the shift rod 106. The reliability of the device is therefore enhanced because the gear position can be changed both by the shift motor 38 and manually. In addition, the operation load when the gear position is changed manually is minimized because the output transmission train of the reduction gear mechanism 110 is broken.

The manual operation mechanism comprises the sliding gear 110*f* provided in the output transmission train of the reduction gear mechanism 110 so as to be slidable in the facewidth direction and the manual lever 120 that can be manually manipulated to slide and rotate the sliding gear 110*f*, and meshing between the sliding gear 110*f* and the fifth gear 110*e* on the upstream side in the output transmission train is disengaged when the sliding gear 110*f* is slid by manual manipulation of the manual lever 120. The gear position can therefore be changed manually with ease.

This embodiment is thus configured to have a device for shifting a gear of an outboard motor (10) adapted to be mounted on a stern of a boat (12) among a forward position, a reverse position and a neutral position such that the boat is propelled by a powered propeller (32) in a direction determined by the gear position, comprising: a clutch (102) being engageable with a forward gear (98) or a reverse gear (100); a shift rod (106) being rotatable to slide the clutch to engage with the gears; an actuator (electric shift motor 38) connected to rotate the shift rod; a speed reduction gear mechanism (110) transmitting an output of the actuator to the shift rod at a reduced speed; and a manual operation mechanism being manually operable by an operator and breaking output transmission train of the speed reduction gear mechanism such that the shift rod can be manually rotated by the operator.

In the device, the manual operation mechanism comprises; a sliding gear (110*f*) provided in the output transmission train of the speed reduction gear mechanism to be slidable in a facewidth direction; and a manual lever (120) being manually manipulatable by the operator to slide and rotate the sliding gear such that the sliding gear is disengaged with a gear (110*e*) on an upstream side in the output transmission train.

In the device, the sliding gear (110*f*) is slidable in the facewidth direction between a first position where it meshes with the gear (110*e*) on the upstream side and a gear (110*g*) on a downstream side in the output transmission train when not slid by the manual lever and a second position where it only meshes with the gear (110*g*) on the downstream side in the output transmission train when slid by the manual lever.

The device further includes: a spring (112) that urges the sliding gear toward the first position.

In the device, the manual lever (120) has a cam member (120*d*) that slides the sliding gear when the manual lever is tipped.

The device further includes: a member (sliding member 124) locking the manual lever not to be manipulated manually.

Although in the foregoing description the actuator for rotating the shift rod 106 is explained as being an electric motor (the shift motor 38), any of various other types of actuators (such as a hydraulic cylinder) can be used instead. Although in the foregoing description the output transmission mechanism for transmitting the output of the shift motor 38 to the shift rod 106 is explained as being constituted solely of gears, a link mechanism or the like can be used instead.

Japanese Patent Application No. 2004-361633 filed on Dec. 14, 2004 is incorporated herein in its entirety.

While the invention has thus been shown and described with reference to specific embodiments, it should be noted that the invention is in no way limited to the details of the described arrangements; changes and modifications may be made without departing from the scope of the appended claims.

What is claimed is:

1. A device for shifting gears of an outboard motor adapted to be mounted on a stern of a boat among a forward position, a reverse position and a neutral position such that the boat may be propelled by a powered propeller in a direction determined by gear position, comprising:

a clutch engageable with a forward gear or a reverse gear;

a shift rod rotatable to slide the clutch to engage with the gears;

an actuator connected to rotate the shift rod;

a speed reduction gear mechanism transmitting an output of the actuator to the shift rod at a reduced speed; and a manual operation mechanism manually operable by an operator to break an output transmission train of the speed reduction gear mechanism such that the shift rod can be manually rotated by the operator; wherein the manual operation mechanism being movable while operatively connected to the speed reduction gear mechanism between a first position in which the output transmission train is not broken and a second position in which the output transmission train is broken.

2. The device according to claim 1, wherein the manual operation mechanism comprises;

a sliding gear provided in the output transmission train of the speed reduction gear mechanism to be slidable in a facewidth direction; and a manual lever manually manipulatable by the operator to slide and rotate the sliding gear such that the sliding gear is disengaged with a gear on an upstream side in the output transmission train.

3. The device according to claim 2, wherein the sliding gear is slidable in the facewidth direction between the first position where it meshes with the gear on the upstream side and a gear on a downstream side in the output transmission train when not slid by the manual lever and the second position where it only meshes with the gear on the downstream side in the output transmission train when slid by the manual lever.

4. The device according to claim 3, further including:

a spring that urges the sliding gear toward the first position.

5. The device according to claim 2, wherein the manual lever has a cam member that slides the sliding gear when the manual lever is tipped.

6. The device according to claim 2, further including:

a member selectively locking the manual lever not to be manipulated manually.

* * * * *